US006109194A

United States Patent [19]

Farb

[11] Patent Number: 6,109,194

[45] Date of Patent: Aug. 29, 2000

[54] EMBROIDERY MACHINE FABRIC HOLDER

[76] Inventor: Deborah G. Farb, 102 Honeywell La., Hyde Park, N.Y. 12538

[21] Appl. No.: 09/061,531

[22] Filed: Apr. 15, 1998

Related U.S. Application Data

[60] Provisional application No. 60/043,702, Apr. 16, 1997.

[51] Int. Cl.[7] ..... D05C 1/02; D06C 3/08

[52] U.S. Cl. ..... 112/103; 38/102.91

[58] Field of Search ..... 112/103; 38/102, 38/102.2, 102.21, 102.91

[56] References Cited

U.S. PATENT DOCUMENTS

| | | | |
|---|---|---|---|
| 3,664,288 | 5/1972 | Weidlin Von Boden et al. | 112/103 |
| 3,886,990 | 6/1975 | Campione | 38/102.91 X |
| 4,357,885 | 11/1982 | Stockton | 112/103 |
| 4,860,467 | 8/1989 | Larson | 38/102.91 X |
| 5,144,899 | 9/1992 | Allen | 112/103 |
| 5,546,877 | 8/1996 | Moore | 112/103 |

FOREIGN PATENT DOCUMENTS

| | | | |
|---|---|---|---|
| 466269 | 1/1992 | European Pat. Off. | 38/102.2 |

*Primary Examiner*—Ismael Izaguirre
*Attorney, Agent, or Firm*—Joseph B. Taphorn

[57] ABSTRACT

An embroidery machine is provided with an attachment for fitting on the bottom of its movable hoop to provide a secure mounting surface for a sheet of "stickum" paper extending across the hoop and providing on its upper "stickum" surface a mounting and securing place for a fabric placed across the top of the hoop.

10 Claims, 5 Drawing Sheets

EMBROIDERY MACHINE FABRIC HOLDER

This patent application is based on provisional patent application Ser. No. 60/043,702 filed Apr. 16, 1997 by the same inventor.

1. Field of the Invention

This invention relates to embroiders machines, and more particulary to an improved arrangement for mounting and holding securely a fabric to be embroidered in a machine.

2. Background of the Invention

Embroidery machines stitch a desired visible pattern on a fabric such as a cloth piece constituting the outside of a pants hip pocket. A typical embroidery machine is the VIKING Husqvarna 1250. The fabric is mounted in such a machine via a hoop. The hoop, a relatively large rectangular ring, attaches on one side by a readily operable connector to a positionable element of the machine, to be moved under the embroidery needle by the positional element in directions necessary to create the desired stitched pattern.

The rectangular hoop is made of two pieces. An outer and bottom piece is the sturdier piece and mounts on an outside edge the readily operable connector. Its inner edge has at its bottom a slightly inwardly-extending flange constituting the seat for the inner piece. The inner and upper piece fits snugly within the outer piece and seats upon the latter's inwardly-extending flange. A piece of fabric stretched across the outer piece will be held in stretched condition across the hoop when the inner piece is pressed down in the outer piece.

Placing a fabric on a conventional hoop is a laborious and tedious process. Moreover small pieces of fabric cannot be securely mounted in such hoops.

3. Prior Art

To minimize one of these problems, persons have applied "adhesive" paper to the underside of the outer piece of the hoop and endeavored to secure thereon a fabric stretched across the top of the hoop for transport thereby during embroidery. This application of the "adhesive" paper has proven ineffective to hold the fabric in stretched condition, primarily because the "adhesive" paper does not adhere adequately to the bottom of the hoop. The application also "cruds" up the loop, impairing its further use.

SUMMARY OF THE INVENTION

Accordingly it is an object of the invention to provide an easier effective way to hold fabric on an embroidery machine hoop.

Another object of the invention is to provide a way to mount small pieces of fabric securely on the large hoop of an embroidery machine.

A more particular object of the invention is to provide an apparatus and method facilitating easier effective placement of a fabric on an embroidery machine hoop.

Another particular object of the invention is to provide an apparatus and method facilitating mounting of small pieces of fabric in the large hoop of an embroidery machine.

A further particular object of the invention is to provide a simple apparatus and method not only facilitating easier effective placement of a fabric on an embroidery machine hoop, but also facilitating mounting of small pieces of fabric on the large hoop of an embroidery machine.

Yet another object of the invention is to provide an apparatus wheren the hoop is not dirtied-up in use or rendered injurious to fabrics.

Still another object of the invention is to provide an apparatus that not only is easy and clean to use, but also one that is plain of construction, easy and inexpensive of manufacture, and simple of installation.

The objects of the invention are achieved through the mounting of an "adhesive" paper across the bottom of the hoop so that a fabric may be laid thereon and effectively held thereby for positioning for desired embroidery design creation. A readily mountable generally— flat loop of approximately the same shape as the hoop is provided to enable effectively securing the "adhesive" paper to the hoop for transport thereby. The loop is easily on mounted underside of the hoop and provided on its underside with a sufficiently large surface to which a piece of appropriately-sized paper having an "adhesive" side may be stuck. This leaves the "adhesive" side of the paper extending across the interior of the loop and hoop holding still a fabric placed thereon.

The loop is readily mounted on the hoop using sprung clamps extending upwardly from the loop: they may be flexed as the loop is moved upwardly to the underside of the hoop and released upon contact to embrace the hoop and hold the loop, and hence the "adhesive" paper securely in place.

The instant invention solves both the laborious and tedious problem involved in removing and reinserting the hoop inner piece, and the small fabric-piece mounting problem. A fabric, regardless of size is more easily and conveniently mounted on the hoop by simply laying it on a securely mounted "adhesive" paper. Thus it retains a taut stretched condition. Moreover, the hoop kept clean.

BRIEF DESCRIPTION OF DRAWINGS OF A PREFERRED EMBODIMENT

These and other objects, features and advantages of the invention will become apparent from a reading of the following description of a preferred embodiment of the invention, when considered with the appended drawings, wherein.

DETAILED DESCRIPTION OF THE PREFERRED INVENTION EMBODIMENT

Figure 1:
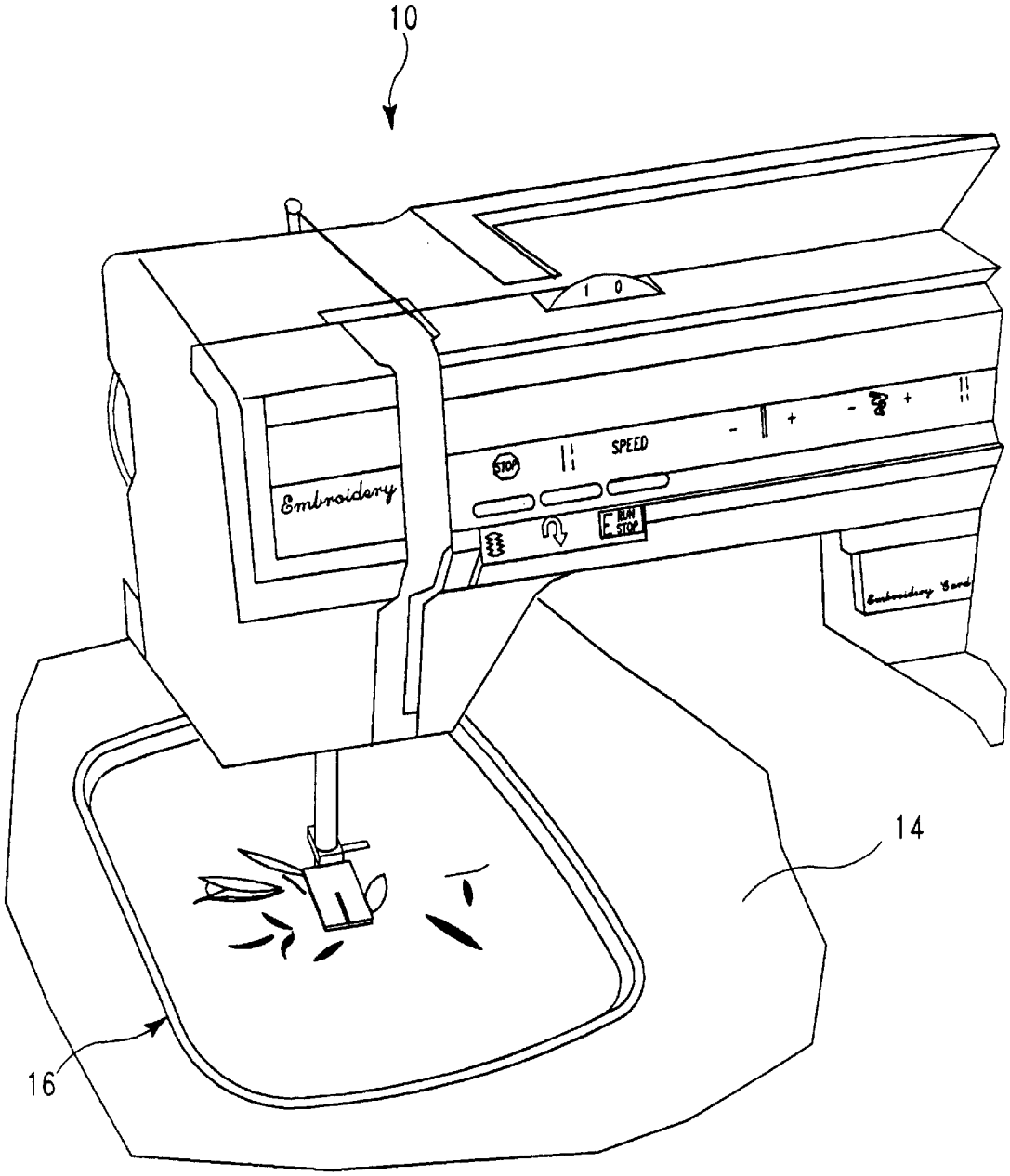
PRIOR ART FIG. 1
FIG. 1 is a reproduction of a photograph of a commercially available embroidery machine stitching a design on a piece of fabric being held by a hoop positioned from underneath.
Figure 2:
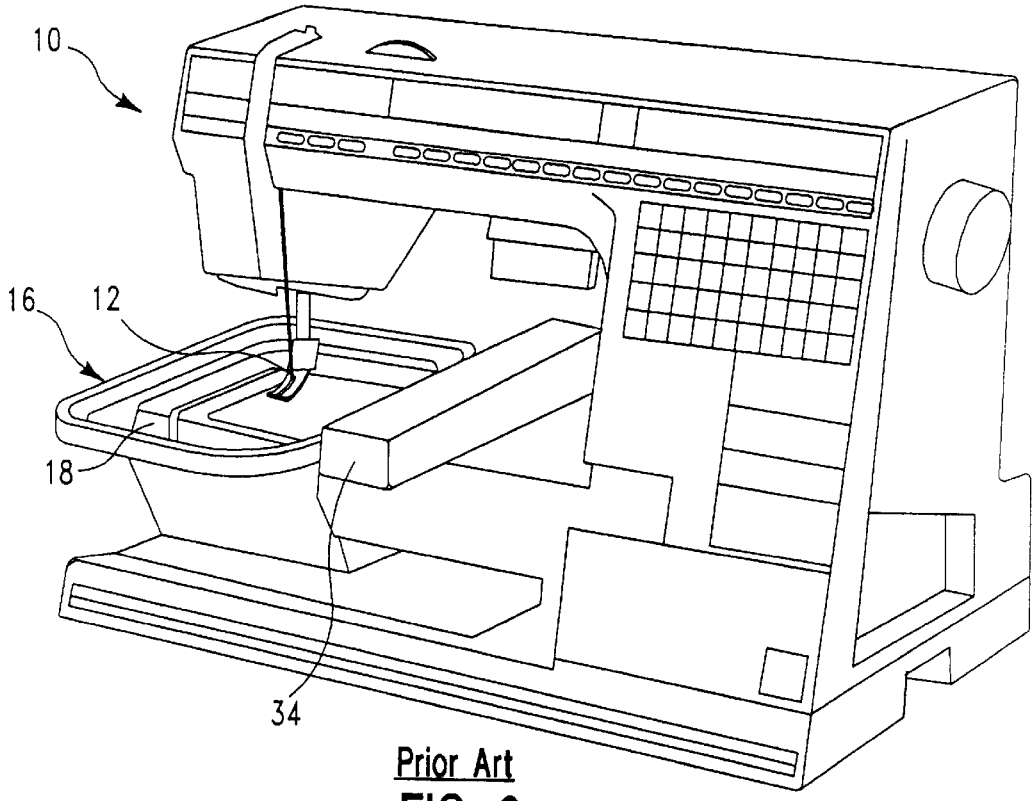
Prior Art FIG. 2
FIG. 2 is a reproduction of another photograph of the commercially available embroidery machine but with the fabric removed.

Referring now more particularly to FIGS. 1 and 2, a commercially-available embroidery machine genrerally indicated by the numeral 10 is shown as including an assembly 12 mounting a reciprocating stitching needle. A fabric 14 to be stitched is supported beneath the stitching needle assembly 12 by a positionable hoop generally indicated by the numeral 16. The positioning of the hoop is controlled by the operator through computer programs.

Positioned on a frame portion of the embroidery machine 10 and below the fabric 14, and coacting with the stitching needle assembly 12, is stitch plate 18.

Figure 3:
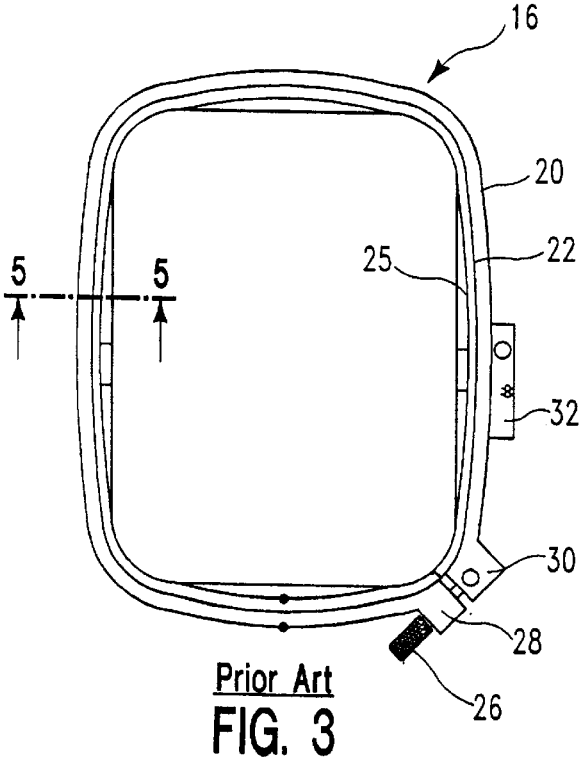
Prior Art FIG. 3
FIG. 3 is a plan view showing the commercially available embroidery hoop with its inner piece seated within its outer piece.
Figure 4:
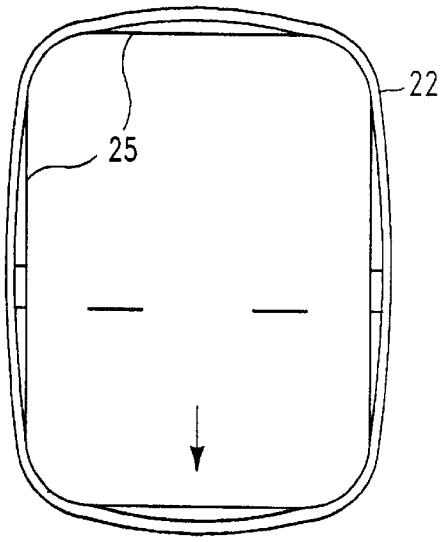
Prior Art FIG. 4
FIG. 4 is a plan view showing the inner piece of FIGS. 1–3 by itself.
Figure 5:
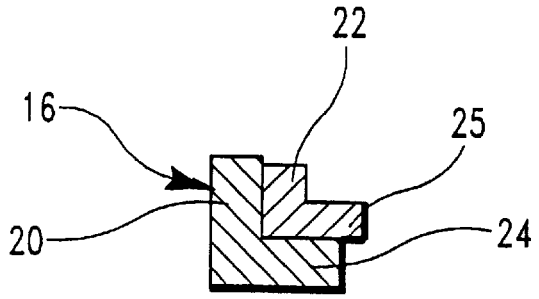
FIG. 5 is a sectional view of the hoop taken along the line 5—5 of FIG. 3.

The positionable hoop 16, generally rectangular in plan view, includes an outer piece 20 (FIG. 3) and an inner piece 22 (FIGS. 3 and 4). The hoop outer piece 20 is essentially a ring which at its bottom inner edge has an inwardly directed ledge 24 (FIG. 5). The outer piece 20 is broken at one corner into two ends held together by an adjustment mechanism comprising a bolt 26 freely rotatably within a sleeve 28 exteriorly mounted on one of the ends and a threaded nut 30 exteriorly mounted on the other end. The right hand side of the outer piece 20 at its midpoint has structures 32 for mounting the hoop 16 on a hoop positioning assemblage 34 (FIG. 2) on the machine 10.

The inner hoop piece 22 (FIGS. 3 and 4) is of the same rectangular shape as the outer piece 20 and of a size so as to fit within it and rest on the ledge 24 (FIG. 5) The inner hoop piece 22 at its inner lower edge on the midpoints of its sides bears inwardly laterally extending flanges 25 which serve a stiffening elements for it. Normally, a piece of fabric large enough to extend over it is first stretched across the hoop outer piece 20 and then the inner piece 22 is seated on the fabric to press it down within the outer piece and the bolt 26 turned to tighten the outer piece on the fabric and inner piece. The hoop 16 is then mounted on the machine hoop positioning assemblage 34 via its stuctures 32.

Figure 7:
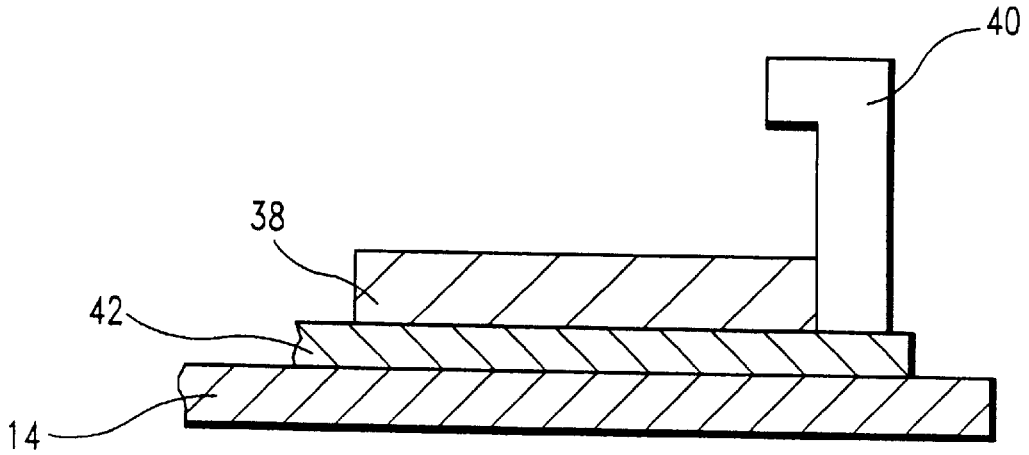
FIG. 7 is a view, taken along the section line 7—7 of FIG. 6, of the loop, with adhesive paper attached.
Figure 8:
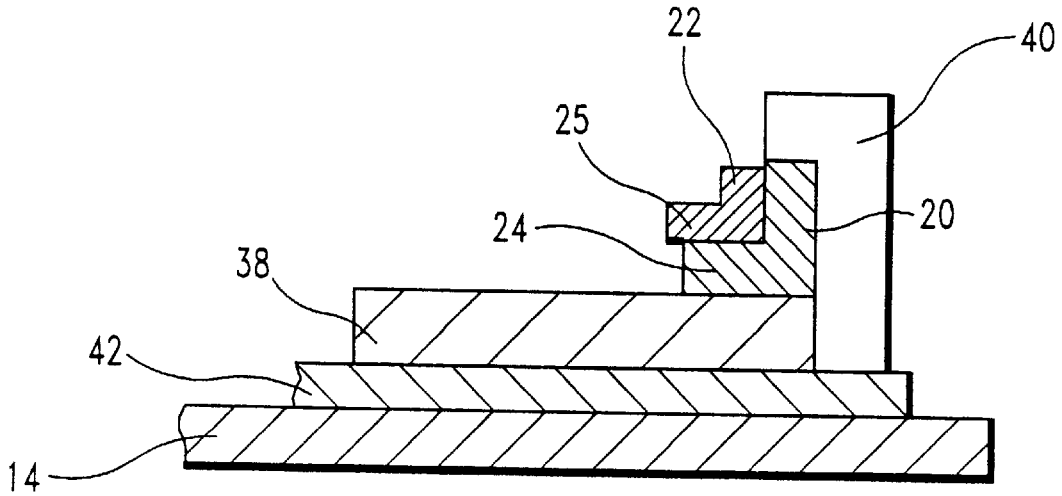
FIG. 8 is a view, as if taken along the section line 7—7 of FIG. 6, of a portion of the loop mounted on a portion of the hoop.
Figure 6:
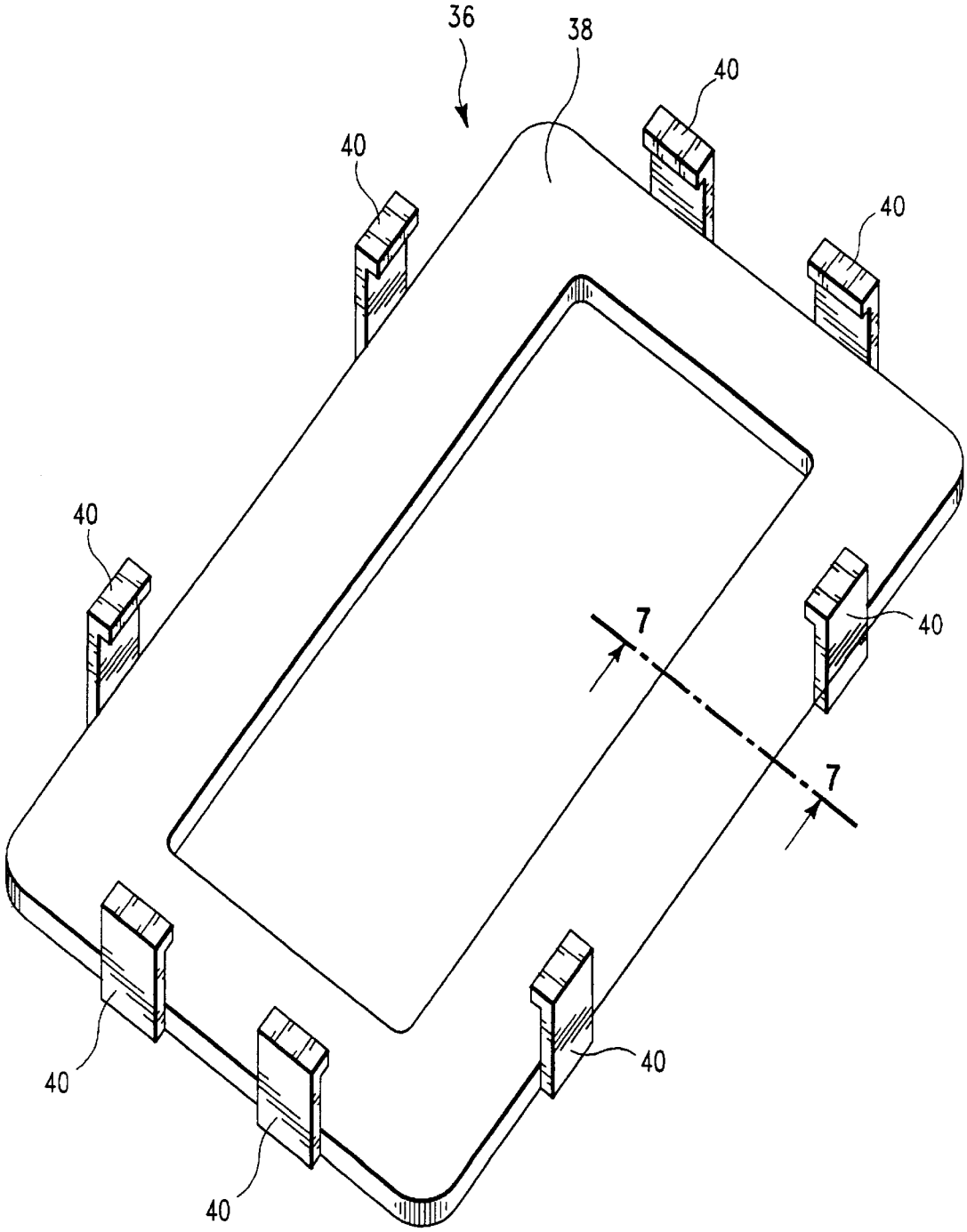
FIG. 6 is a view in perspective of a loop employed in my invention.
Figure 9:
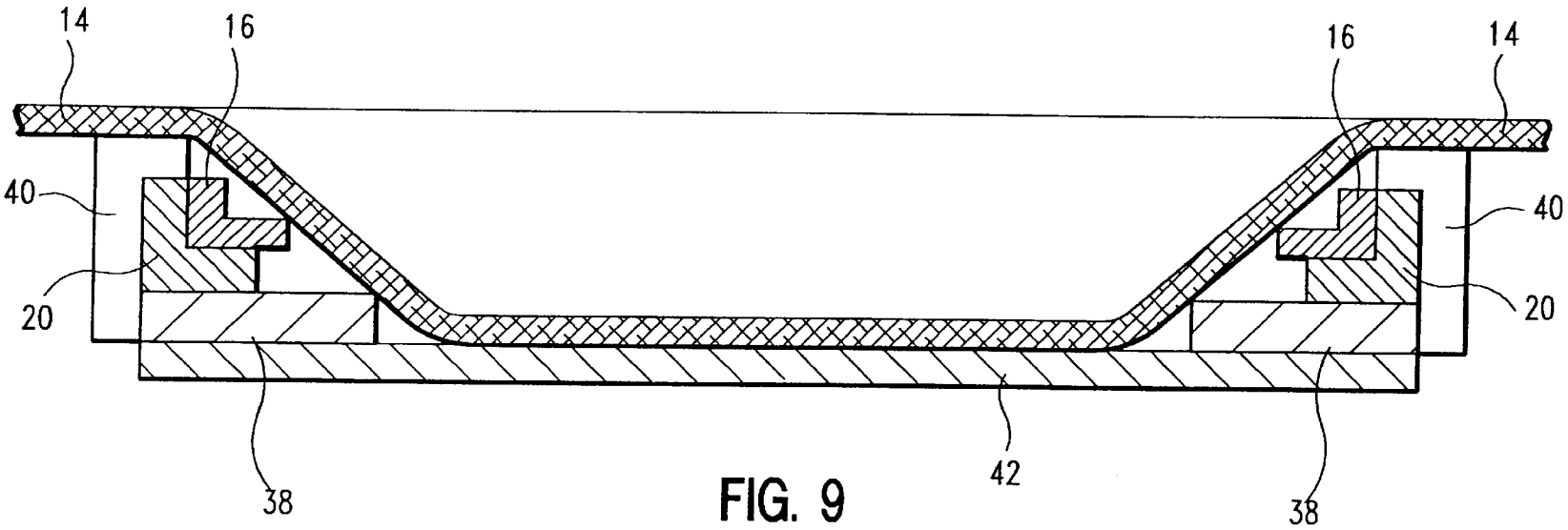
FIG. 9 is a sectional view of a hoop mounting a loop holding a fabric via an "adhesive" paper, as if taken along the section line 7—7 of FIG. 6.

The structure of the invention is shown in FIGS. 6 and 7. As best seen in FIG. 6. a readily mountable loop generally indicated by the numberal 36 of approximately the same shape as the hoop. The loop 36, of a flexible material, consists of a generally-flat ring 38 easily mounted on underside (as seen in FIGS. 6 and 7) of the hoop 16 via pairs of integral clamps 38 biased inwards at their free ends so as to embrace the hoop 16 for transport therewith. The ring 38 on its underside bears a surface of sufficient size and adhesion to hold by sticking a piece of appropriately-sized commercialiy-avaiiable paper 42 having "adhesive" side. This leaves the "adhesive" side of the paper 42 extending across the interior of the loop and the interior of the hoop when mounted thereon.

The flexible loop 36 may he made of a clear plastic such as PETG (polyethylene terephthalate glycol comonomer). Of course, other materials may be substituted.

In use, a loop 36 would have been applied to a free hoop 16. A sheet of "adhesive" paper 42 would have been stuck to the underside of the loop 36 so as to be secured thereto. An extended or small piece of fabric 14 to be embroidered would be stretched across the hoop and pressed down into engagement with the "adhesive" side of the paper 42, and embroidery operations engaged in. After the embroidery design is completed, the fabric is readily pulled off and a new piece of fabric substituted. When the "adhesive" paper looses its effectiveness, the loop is readily removed and a new "adhesive" paper substituted on it.

While there has been shown and described a preferred embodiment of the invention, it will be apparent to those skilled in the art that other and different applications may be made of the principles of the invention. It is desired therefore to be limited on by the scope or spirit of the appended claims.

What is claimed is:

1. An embroidery machine comprising a reciprocal stitching assembly, a hoop positionable to create a design, and an adhesive paper extending across and firmly secured to the hoop for holding a fabric in place during embroidery, wherein the hoop has a bottom and the adhesive paper extends across the bottom of the hoop, wherein the adhesive paper is carried by a frame attachment to the hoop.

2. An embroidery machine comprising a reciprocal stitching assembly, a hoop positionable to create a design, and an adhesive paper extending across and firmly secured to the hoop for holding a fabric in place during embroidery, wherein the hoop has a bottom and the adhesive paper extends across the bottom of the hoop, wherein the adhesive paper is carried by an attachment to the hoop, wherein the attachment is a ring providing an extended adhesion surface.

3. A machine according to claim 2, wherein the ring is formed with integral sprung clamps that may be flexed to embrace the hoop.

4. Anti-soiling apparatus for transporting a fabric in an embroidery machine having a positionable element which is readily attachable thereto and removable therefrom, comprising a generally flat ring-shaped structure constituting a solid frame and connectable to the positionable element of the embroidery machine, and an adhesive material that faces upwards on the under side of the structure.

5. Anti-soiling apparatus for transporting a fabric in an embroidery machine having a positionable element and readily attachable threto and removable therefrom, comprising a generally flat ring-shaped structure connectable to the positionable element of the embroidery machine, and an adhesive material that faces upwards on the under side ofthe structure, wherein the positionable element includes a hoop to which the ring-like structure is secured.

6. Apparatus according to claim 4, wherein the structure comprises an extended flat surface for presenting to the "adhesive" material.

7. A loop for having stuck on it the adhesive side of a paper for carrying within the loop a fabric to be stitched with a visible design in an embroidery machine having a transportable hoop, comprising a ring of a material flat in the plane of the ring, wherein the ring is of a flexible material and has upwardly and inwardly extending flanges on its outer edges for engaging the transportable hoop of an embroidery machine.

8. A loop according to claim 7, and a sheet of "stickum" material attached to the loop by the "adhesive" on the material.

9. A method of transporting a fabric in an embroidery machine having a fabric transport element and an attachment thereto, comprising securing an adhesive material to the transport element adhering the fabric to the adhesive material, and operating the machine to move the fabric, wherein the transport element is a hoop, wherein the adhesive material is adhered to said attachment to the machine.

10. A method according to claim 9, wherein the attachment is secured to the positionable element of the machine.

* * * * *